US005263876A

United States Patent [19]

Johnescu et al.

[11] Patent Number: 5,263,876

[45] Date of Patent: Nov. 23, 1993

[54] MODULAR EMI-EMP CONNECTOR ASSEMBLY

[75] Inventors: Douglas M. Johnescu, Gilbertsville; Ronald W. Morse, Sidney, both of N.Y.

[73] Assignee: Amphenol Corporation, Wallingford, Conn.

[21] Appl. No.: 945,149

[22] Filed: Sep. 15, 1992

[51] Int. Cl.[5] ..... H01R 13/66; H01R 13/518

[52] U.S. Cl. ..... 439/620; 439/598; 439/701

[58] Field of Search ..... 439/95, 608, 620, 597-599, 439/357, 701, 353, 355, 350, 351, 108, 686, 688-690, 695

[56] References Cited

U.S. PATENT DOCUMENTS

| | | | |
|---|---|---|---|
| 1,794,77 | 3/1931 | Kliegl | 439/353 |
| 4,611,880 | 9/1986 | Petersen et al. | 439/599 |
| 4,741,710 | 5/1988 | Hogan et al. | 439/620 |
| 4,746,310 | 5/1988 | Morse et al. | 439/620 |
| 4,813,891 | 3/1989 | Walters et al. | 439/620 |
| 5,190,479 | 3/1993 | Jordi | 439/620 |

FOREIGN PATENT DOCUMENTS

| | | | |
|---|---|---|---|
| 2909616 | 9/1980 | Fed. Rep. of Germany | 439/357 |
| 2014804 | 8/1979 | United Kingdom | 439/620 |
| 2159345 | 11/1985 | United Kingdom | 439/350 |

*Primary Examiner*—Gary F. Paumen

*Attorney, Agent, or Firm*—Bacon & Thomas

[57] ABSTRACT

A modular electrical connector assembly includes a shell containing a plurality of separate bays, each bay being adapted to accept an EMI/EMP electrical connector insert or module. A unique latch structure enables each connector module to be easily removed from its bay to enable fast and easy replacement of defective modules or the EMI/EMP components contained therein.

31 Claims, 5 Drawing Sheets

MODULAR EMI-EMP CONNECTOR ASSEMBLY

BACKGROUND OF THE INVENTION

1. Field of the Invention

This invention relates to the field of electrical connectors, and in particular to electrical connectors having filtering and/or transient suppression capabilities.

2. Description of Related Art

Electrical connectors which protect electrical circuits from electro-magnetic interference (EMI) and transient signals such as electromagnetic pulses (EMP), lightening and other voltages having pulses of extremely short duration and high amplitudes have become increasingly indispensable in a variety of electrical connector applications, in particular in military and aerospace applications. As such connectors become increasing common, issues of compatibility, ease-of-use, cost, and repairability take on increasing significance.

In the initial stages of the development of a new technology, standardization and mass production are primary objectives. Later in the development of the new technology, however, modularization, in which the customer is able to adapt a design to his particular requirements by arranging a variety of standard or custom components within a common framework, becomes an attractive option. Often, a modular product can render obsolete the original standardized design.

At this stage in the development of the technology, seemingly minor improvements can make a big difference. The key to the success of a new modular design can, for example, be as simple, and unexpected, as an improved latch which permits easy replacement of the module. The present invention involves such a breakthrough latch design. While simple in concept and implementation and superficially similar to latches used in other contexts, the inventive latch nevertheless represents a fundamental change which permits modularity to be achieved in the context of electrical connectors of the type which use EMI or EMP components.

Plural connector assemblies have previously been proposed, and a variety of latches are known for mating separate connectors together, but none of these designs is suitable for use as part of an EMI/EMP system in which the individual components in the connectors are desirably removed for repair or replacement. In fact, a prior modular assembly, disclosed in U.S. Pat. No. 4,659,163, teaches that the filter components in an EMI-/EMP system should be fixed in the modular housing frame, rather then removable with the modules.

Because the technology of transient suppression and filter components designed to fit within connectors is well developed, the present invention concerns the interface between the modules and the modular housing rather than with a specific arrangement for fitting components within the modules, although one particular arrangement for fitting EMI/EMP components in a module is disclosed. The invention thus concerns a latch, and also a seal and a ground arrangement for the module with advantages in the areas of ease-of-use, cost, and repairability, rather than filtering performance. Although simple in design, the invention nevertheless represents a significant improvement in a technology which has reached the point where evolutionary changes can have revolutionary results.

SUMMARY OF THE INVENTION

It is a first objective of the invention to provide a modular filter and/or transient suppression (EMI-EMP) connector assembly in which individual connector dimensions are within present connector envelopes, and which allows for easy interchangeability and replacement of unprotected connectors already in the field.

It is a second objective of the invention to provide an EMI/EMP connector assembly which utilizes otherwise standard EMI-EMP connectors which are modified to include an improved latch for providing secure retention of the connectors in the assembly and easy removability.

It is a third objective of the invention to provide a modular EMI-EMP connector assembly which provides secure retention of the connector modules in the assembly and an effective grounding and sealing arrangement for each individual connector module.

These objectives are achieved by providing a modular electrical connector assembly which uses a standard ARINC 600-type interface, and provides for front removability of damaged or questionable EMI-EMP connector modules, thus permitting removal and replacement without tieing up valuable time for testing, and without requiring disconnection of the cables or PCB to which the rear portions of the connector modules are attached. Each filter element is grounded to a housing of the assembly through a continuous, replaceable groud spring, ensuring that the ground path has a minimum amount of inductive, capacitive, and resistive reactance while providing optimum filter performance, the transient suppression elements being grounded to the housing by a conventional ground plate design of proven reliability and effectiveness. Sealing is provided by an interfacial seal at the rear of each module, in cooperation with standard seals provided in the modules themselves.

The retention latch is a molded-in two-tine latch which, when pushed into the housing and past a specially designed shell undercut, compresses and snaps back to hold the insert in place. To remove the insert, an insert removal tool is placed over the tines, compressing the tines so that they no longer latch onto the shell undercut. When the tool has compressed the tines and is pushed sufficiently into the housing, a pair of protrusions or hooks provided on the removal tool engage insert removal nubs provided on the connector module which allow for the insert to be pulled out. The tines preferably extend parallel to the connector module housing, with hooks extending perpendicular to the direction of insertion, in the plane tangential to a sidewall of the connector module housing.

DETAILED DESCRIPTION OF THE PREFERRED EMBODIMENTS

Figure 1:
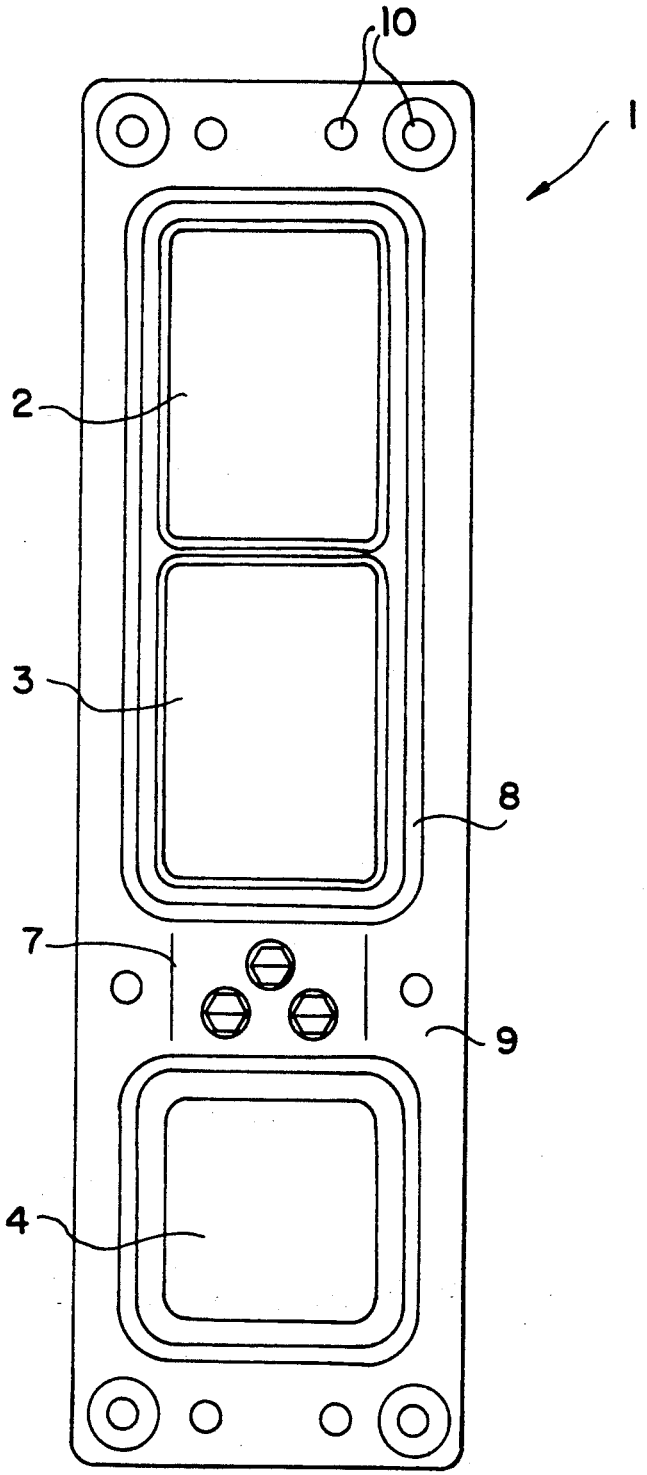
FIG. 1 is an elevated front view of a modular EMI-EMP connector assembly constructed in accordance with principles of a preferred embodiment of the invention.
Figure 2:
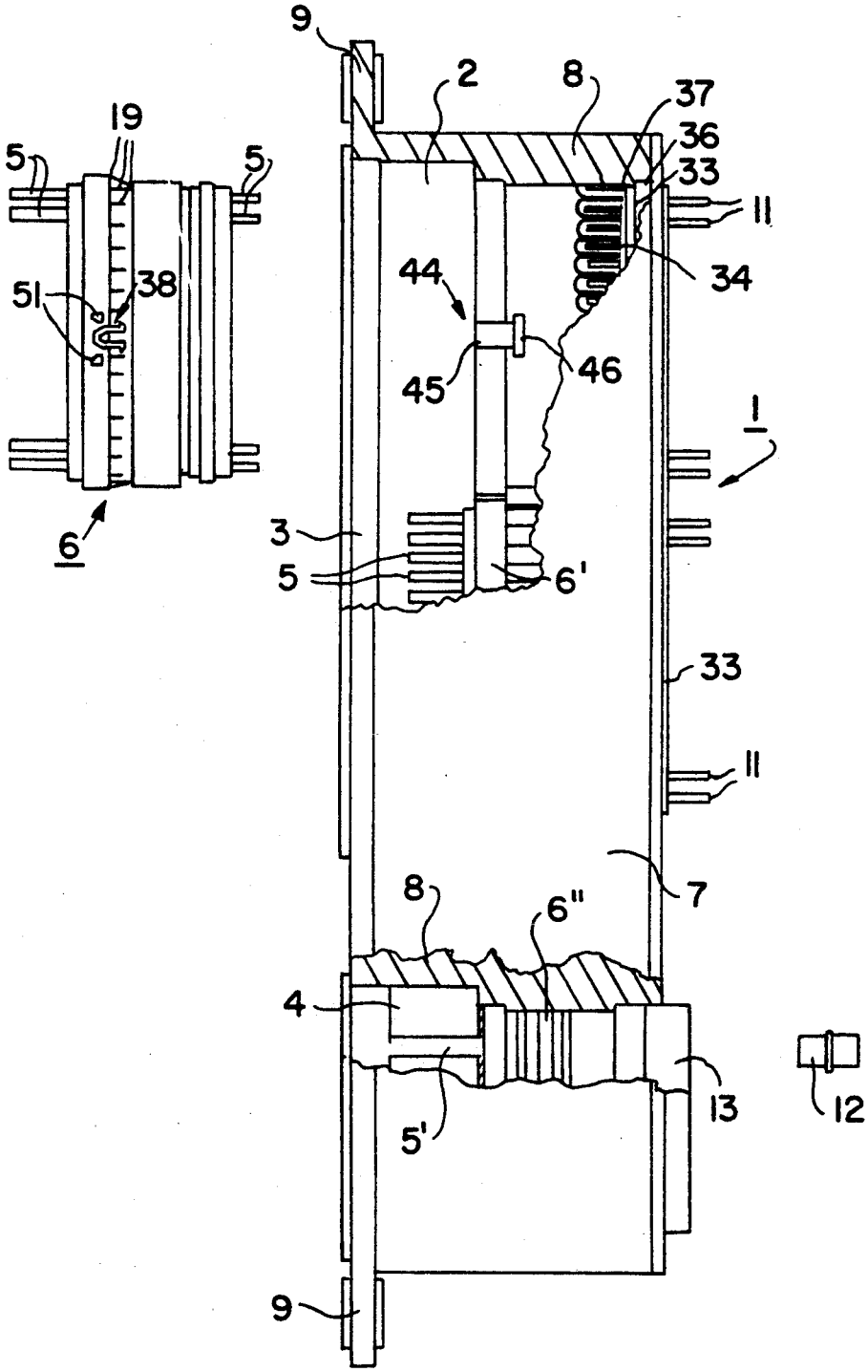
FIG. 2 is a side view, partially in cross-section, of the connector assembly of FIG. 1.
Figure 3:
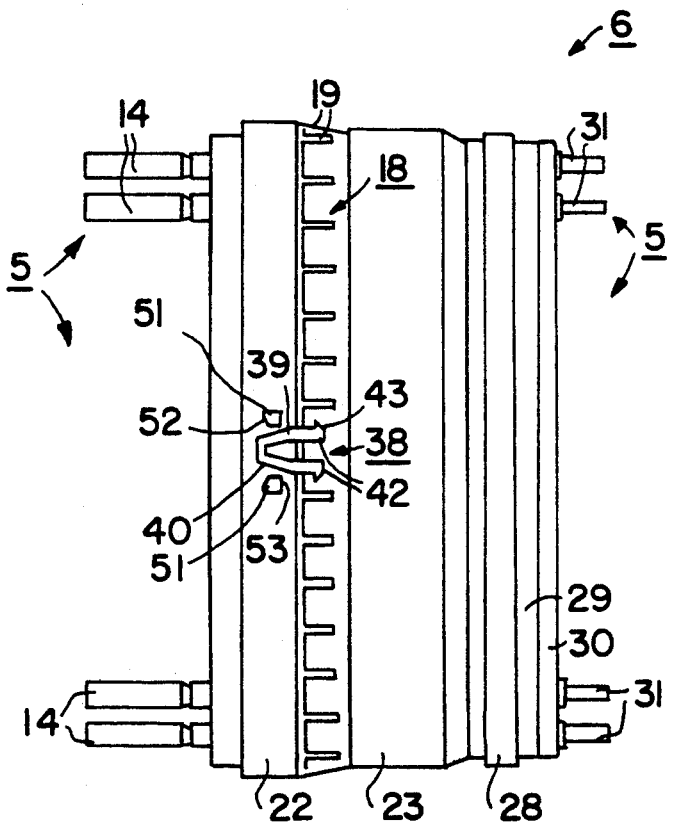
FIG. 3 is an elevated side view of an insert unit for the connector assembly of FIG. 1.

FIGS. 1 and 2 are, respectively, front and side views of a preferred connector assembly 1 having three connector insert bays 2–4. A plurality of interface contacts 5 and all TVS or filter components (described in more detail below) are contained in connector inserts or modules 6, 6', and 6" which are arranged to fit within bays 2–4. The number of bays is of course optional, as are the type of components contained within the inserts 6, 6', and 6", although a particularly advantageous configuration for TVS and filter components is shown in FIG. 5.

The preferably metal shell 7 of connector assembly 1 includes a main housing frame 8 and a flange 9 having apertures 10 for mounting the assembly on a panel. Shell 7 is illustrated as being provided with PCB tails 11 to which contacts 5 are electrically connected, PCB tails 11 forming means for electrically connecting contacts 5 with electrical conductors, such as circuit board traces, in an electrical device. In addition, one of the bays 4 is shown as being provided with crimp socket contacts 12 and an E-grommet 13, the contacts 5' of the insert 6" being modified accordingly. Insert 6' is identical to insert 6.

Figure 5:
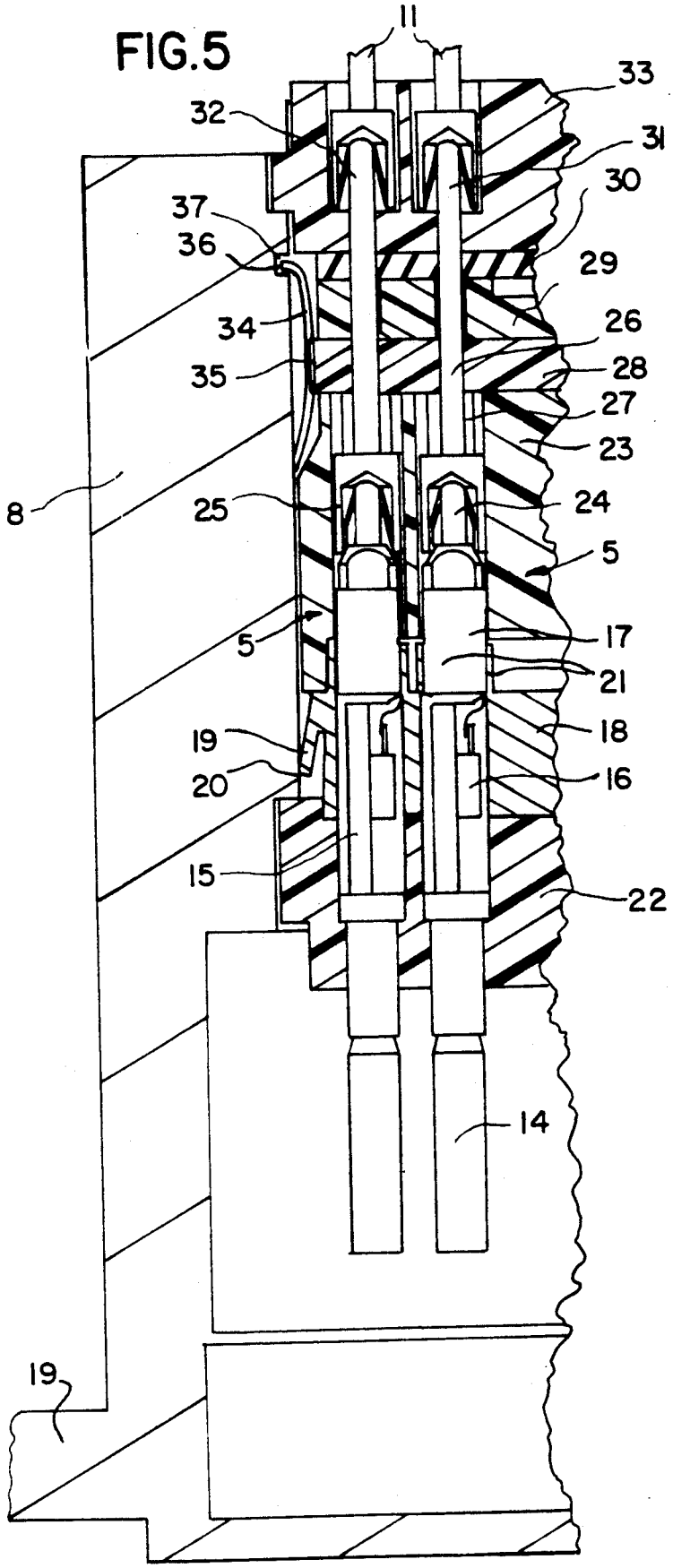
FIG. 5 is an enlarged cross-sectional side view of portions of the connector insert and connector assembly of FIG. 3.

Turning to FIG. 5, the TVS contacts 5 contained in the exemplary connector insert or module 6 are of known type and include socket mating section 14 and a TVS component mounting section 15 on which is mounted a diode 16 electrically connected to a conductive ground sleeve 17. The ground sleeve 17 is fitted around contact 5 and an insulator sleeve (not shown) and grounded to main housing frame 8 by ground plate 18. Ground plate 18 includes a plurality of tines 19 around its periphery which extend from the insert to resiliently engage an inner surface 20 of frame 8. Electrical contact between the ground sleeve 17 and ground plate 18 is established by tines 21 extending from edges of the apertures through which contacts 5 pass. In order to form the connector insert or module, ground plate 18 is sandwiched between and affixed to a dielectric front insert 22 and a dielectric rear insert 23.

For ease of repairability, contacts 5 are formed in two parts, the first part including sockets 14, mounting section 15 and end portions 24 which mate with socket portions 25 of rear contact halves 26. Rear contact halves 26 extend through insert 23, ferrite filter elements 27, a monolithic filter capacitor 28, a dielectric spacer element 29, and an interfacial seal 30.

Rear contact halves 26 include termination ends 31 which are inserted into sockets 32 provided on PCB tails 11. PCB tails 11 extend through and are secured by a dielectric back portion 33 of the otherwise metal housing frame. Alternatively, the insert contacts may terminate in the crimp socket 12 and E-grommet 13 arrangement shown for bay 14 in FIG. 2. The monolithic filter capacitor 28 is grounded to housing frame 8 via a ground strap 34 which contacts an electrode 35 provided around the periphery of capacitor 28 and which is retained in the housing 8 by engagement between an extension 36 end of strap 34 and a notch or groove 37 provided in frame 8.

As shown in FIGS. 3 and 4A–E, U-shaped retention latch 38 is molded into front insert 22 and includes two tines 39 having camming sections 40, main sections 41 and hook portions 42. Hook portions 42 also include camming portions 43 and extend outwardly within a plane which is tangential to a side of the connector insert or module in order to be received within a specially designed undercut 44 in the main housing frame 8.

On each side of the latch, an insert removal nub 51 is also molded into the front insert 22. Each nub 51 includes a camming surface 52 and a bottom surface 53 whose function will become apparent below. The undercut 44 extends in the direction of insertion of the connector insert and has two sections, one section 45 of which has a width which is less than the normal unstressed distance between tips of hook portions 42 on the latch. The second section 46 of undercut 44 is wider than the unstressed distance between portions 42 to form shoulders 47.

Insertion of the connector inserts or modules into the shell is accomplished as follows:

When the connector insert latch 38 is pushed into the assembly 1, it compresses as camming portions 43 of hooks 42 engage the narrow portion 45 of undercut 44. After hooks 42 clear portion 45 and enter wider portion 46, tines 39 snap back to cause the hooks to engage the shoulders and hold the connector module or insert in the shell.

Figure 4A:
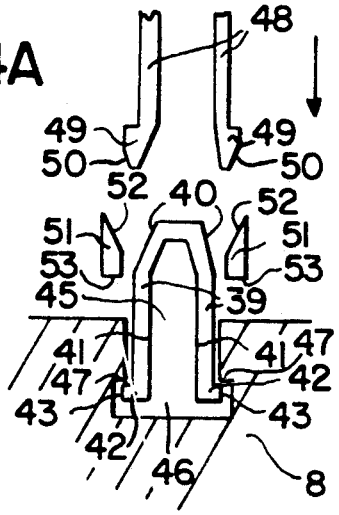
FIGS. 4A–4E are enlarged elevated side views illustrating the manner in which the insert unit of FIG. 3 is removed from the connector assembly of FIG. 1.
Figure 4B:
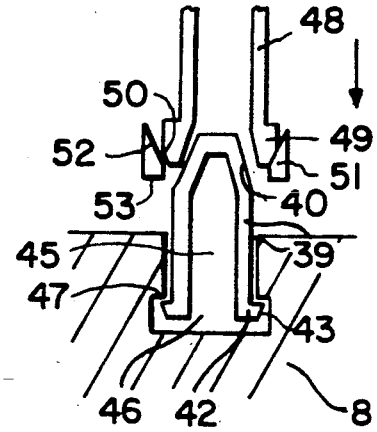
Figure 4C:
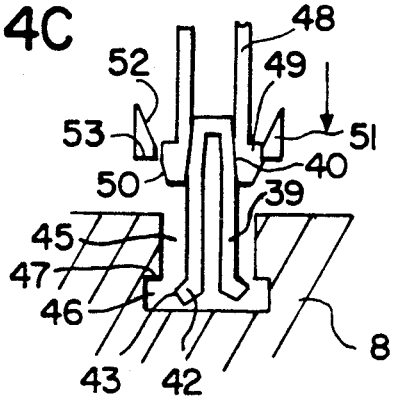
Figure 4D:
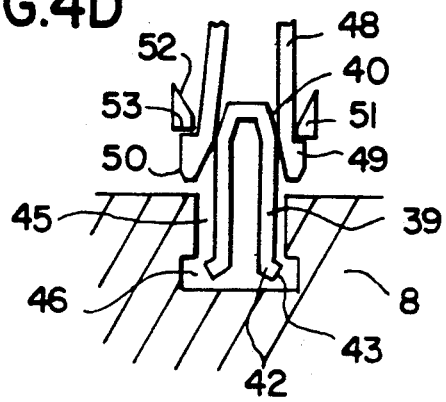
Figure 4E:
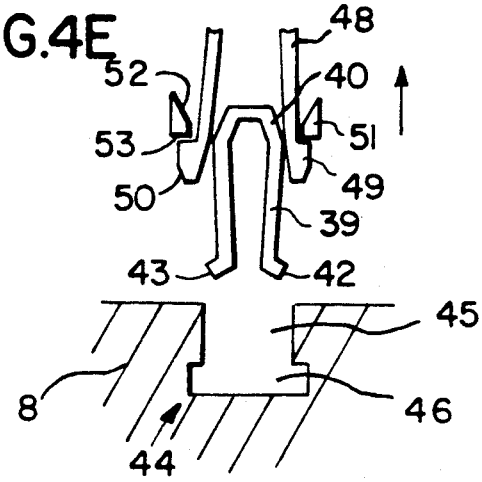

Removal of the connector inserts or modules form the shell is accomplished as follows, with reference to FIGS. 4A to 4E:

During removal, a removal tool having two flexible tines 48 and hooks 49 including camming portions 50 is inserted (see FIG. 4A) such that hooks 49 on the removal tool engage both the camming portions 40 of the latch member and the camming portion 52 on removal nub 51 to cause main portions or tines 39 to flex inwardly and cause the hooks 42 to disengage the shoulders 47 as shown in FIGS. 4B and 4C. Upon continuing to be pushed into the connector module bay, hooks 49 are compressed by the insert removal nubs 51 until they pass the nubs, as shown in FIG. 4D, at which time hooks 49 engage the bottom surfaces 53 of the removal nubs 51, while at the same time holding the latch hooks 42 away from the shoulders 47, and permitting the connector module to be pulled out of the assembly, as illustrated in FIG. 4E.

Having thus described an example of a modular connector assembly in accordance with a specific preferred embodiment of the invention, it will nevertheless be appreciated that the invention should not be limited by the above disclosure since it is anticipated that numerous variations of the invention will occur to those skilled in the art. Therefore, it is intended that the invention be limited solely by the appended claims and not by the above disclosure or illustrations.

We claim:

1. A modular connector assembly for removably retaining an electrical connector module which contains a plurality of electrical contacts and an EMI-EMP component, comprising:

a frame including bay defining means for defining a connector module insertion bay and connecting means for electrically connecting said electrical contacts with electrical conductors in an electrical device;

an undercut in the frame, said undercut extending in a direction of insertion of a connector module into the insertion bay and including shoulders formed by a wide portion at a rear of the undercut and a narrower portion at a front of the undercut as defined by the direction of insertion, said shoulders forming means for engaging hook portions of a latch provided on said module;

means including a ground strap for electrically connecting said EMI-EMP component to said frame; and ground strap retaining means for retaining said ground strap in said insertion bay prior to insertion of a connector module into the insertion bay.

2. As assembly as claimed in claim 1, wherein said connecting means comprise PCB tails.

3. An assembly as claimed in claim 1, wherein said insertion bay is substantially rectangular and arranged to fit ARINC dimensions.

4. An assembly as claimed in claim 1, wherein said ground strap retaining means includes a notch in said frame for receiving an extension on said ground strap arranged to fit within said notch.

5. An assembly as claimed in claim 1, wherein said bay defining means defines a plurality of insertion bays.

6. A connector module including a plurality of electrical contacts and arranged to be removably retained in a modular connector assembly frame, said frame including means for defining an insertion bay and means for connecting the electrical contacts in the module with electrical conductors in an electrical device, comprising:

an insert member including means for retaining the plurality of contacts in said module; and a molded-in latch, said latch including hooks which extend within a plane tangential to an exterior surface of the insert for engaging shoulders provided in an undercut in said frame, wherein transient voltage suppression components are mounted on said contacts.

7. A module as claimed in claim 6, wherein said latch comprises two flexible tines, each including one of said hooks.

8. A module as claimed in claim 7, wherein said tines comprise camming means for facilitating removal of the module from a insertion bay by causing said tines to flex towards each other when engaged by an insert removal tool.

9. A module as claimed in claim 8, further comprising nubs extending from said module adjacent said hooks for engaging hook portions of the insert removal tool in order to facilitate removal of the module from the connector assembly as the tool is withdrawn from the connector assembly.

10. A module as claimed in claim 7, further comprising nubs extending from said module adjacent said hooks for engaging hook portions of an insert removal tool in order to facilitate removal of the module from the connector assembly as the tool is withdrawn from the connector assembly.

11. A module as claimed in claim 6, further comprising an electrical filter element.

12. A module as claimed in claim 11, wherein said filter element includes a peripheral electrode which engages a ground strap secured in said frame when said module is installed in an insertion bay.

13. A module as claimed in claim 12, further comprising a ground plate for electrically connecting said transient voltage suppression components to the frame, said ground plate including tines extending from said module to engage said frame when said module is installed in an insertion bay.

14. A module as claimed in claim 6, further comprising a ground plate for electrically connecting said transient voltage suppression components to the frame, said ground plate including tines extending from said module to engage said frame when said module is installed in an insertion bay.

15. A module as claimed in claim 6, wherein said module fits within the substantially rectangular profile of an ARINC connector.

16. An arrangement for removably retaining an electrical connector module in a modular connector assembly, the connector module containing a plurality of electrical contacts, comprising:

a frame including bay defining means for defining a connector module insertion bay and connecting means for electrically connecting the electrical contacts with electrical conductors in an electrical device;

a molded-in latch on said module; and an undercut in the frame, said undercut extending in a direction of insertion of a connector module into the insertion bay and including shoulder formed by a wide portion at a rear of the undercut and a narrower portion at a front of the undercut as defined by the direction of insertion, said shoulders forming means for engaging hook portions of a latch provided on said module, wherein said module includes means for retaining the plurality of contacts and said molded-in latch, said latch including tangentially extending hooks for engaging said shoulders.

17. An assembly as claimed in claim 16, wherein said latch comprises two flexible tines each including one of said hooks.

18. A module as claimed in claim 17, wherein tines comprises camming means for facilitating removal of the module from a connector bay by causing said tines to flex towards each other when engaged by an insert removal tool.

19. A module as claimed in claim 18, further comprising nubs extending from said module adjacent said hooks for engaging hook portions of the insert removal tool in order to facilitate removal of the module from the connector assembly as the tool is withdrawn from the connector assembly.

20. A module as claimed in claim 19, further comprising nubs extending from said module adjacent said hooks for engaging hook portions of an insert removal tool in order to facilitate removal of the module from the connector assembly as the tool is withdrawn from the connector assembly.

21. A module as claimed in claim 16, wherein transient voltage suppression components are mounted on said contacts.

22. A module as claimed in claim 21, further comprising an electrical filter element.

23. A module as claimed in claim 22, wherein said filter elements includes a peripheral electrode which engages a ground strap secured in said frame when said module is installed in an insertion bay.

24. A module as claimed in claim 23, further comprising a ground plate for electrically connecting said transient voltage suppression components to the frame, said ground plate including tines extending from said module to engage said frame when said module is installed in an insertion bay.

25. A module as claimed in claim 21, further comprising a ground plate for electrically connecting said transient voltage suppression components to the frame, said ground plate including tines extending from said module to engage said frame when said module is installed in an insertion bay.

26. A module as claimed in claim 16, wherein said module fits within the substantially rectangular profile of an ARINC connector.

27. An assembly as claimed in claim 16, wherein said connecting means comprise PCB tails.

28. An assembly as claimed in claim 16, wherein said insertion bay is substantially rectangular and arranged to fit ARINC dimensions.

29. An assembly as claimed in claim 16, further comprising means for retaining a ground strap for electrically connecting EMI-EMP components in said connector module to said frame.

30. An assembly as claimed in claim 29, wherein said ground strap retaining means includes a notch in said frame for receiving an extension on said ground strap arranged to fit within said notch.

31. An assembly as claimed in claim 16, bay defining means defines a plurality of insertion bays.

* * * * *